US005518715A

United States Patent [19]

Rosenblatt

[11] Patent Number: 5,518,715

[45] Date of Patent: May 21, 1996

[54] TUBE CONTAINER EMPLOYING A ROTATING BASE

[76] Inventor: Jerry Rosenblatt, 398 Beach Rd., Burlingame, Calif. 94010

[21] Appl. No.: 398,792

[22] Filed: Mar. 6, 1995

[51] Int. Cl.[6] ..... A61K 7/32; A61K 7/38; A61K 33/06

[52] U.S. Cl. ..... 424/65; 424/698

[58] Field of Search ..... 424/65, 698

[56] References Cited

U.S. PATENT DOCUMENTS

| | | | |
|---|---|---|---|
| 1,476,965 | 12/1923 | Grant | 424/73 |
| 1,510,934 | 10/1924 | Grant | 424/73 |
| 1,527,745 | 2/1925 | Miller | 424/73 |
| 2,230,083 | 1/1941 | Montenier | 424/65 |
| 2,626,847 | 1/1953 | Brown | 424/65 |
| 2,838,442 | 6/1958 | McMaster | 424/73 |
| 2,890,987 | 6/1959 | Hilfer | 424/65 |
| 3,180,827 | 4/1965 | Martinek et al. | 424/65 |
| 5,399,364 | 3/1995 | Verdan | 424/698 |

*Primary Examiner*—Shelley A. Dodson

[57] ABSTRACT

A tube container for dispensing solid crystal deodorant including a cylindrical tube for housing the solid crystal deodorant having an open end and a closed end. The closed end has an aperture for rotatably securing a threaded sleeve which is rigidly connected to a rotatable cylindrical base. A platform member for supporting and vertically displacing the crystal deodorant is contained in the cylindrical tube. The platform member is comprised of a disk and a threaded stem which extends downward from the disk portion of the platform member. The platform member also has a frictional projection extending upward from the disk which fits tightly into a hole in the bottom of the crystal deodorant. The cylindrical tube has an elongated slot disposed on its inside surface which engages with a notch disposed on the periphery of the disk of the platform member to prevent rotatational movement of the platform member. The cylindrical tube is closed at its open end by a cap. Vertical upward displacement of the crystal deodorant within the cylindrical tube is accomplished by rotating the cylindrical base clockwise relative to the cylindrical tube. This causes the threaded sleeve to rotate around the threaded stem of the platform member in the same clockwise direction which in turn causes the platform member to move upward. Vertical downward displacement of the crystal deodorant is accomplished by rotating the base in the counterclockwise direction.

5 Claims, 4 Drawing Sheets

TUBE CONTAINER EMPLOYING A ROTATING BASE

FIELD OF THE INVENTION

The present invention relates to a tube container with a rotating base for dispensing solid products, and more particularly, for dispensing solid rock-like crystal deodorant.

BACKGROUND OF THE INVENTION

A number of personal care products, which are solid at room temperature, are packaged in tubular containers constructed to expose a small amount of the product at the open upper end of the container. Typically, these containers have a cap over the open end to enclose the product when it is stored or not in use. Products of this type typically are lipstick, stick deodorant, eye color, facial blushes and the like. Most products of the type mentioned above, while they are solid at room temperature, are soft and of a wax-like consistency.

Crystal rock deodorant is gaining increasing consumer acceptance due to its long life. Contrary to the products listed above, this crystal rock is made from natural mineral salts and does not contain any moisture and therefore must be wetted with water prior to its use. To use these crystal deodorants, the user wets the top end of the crystal. When wet, the top end of the crystal serves as an applicator for the mineral salts of the crystal. The crystal is then rubbed over the area of the body to which the deodorant is to be applied. After use, the crystal is retracted into the container and allowed to dry.

U.S. Pat. No. 5,286,126 describes a solid rock-like crystal deodorant push-up dispenser. The push-up dispensers of the type described in U.S. Pat. No. 5,286,126 require the user to push down on the top of the crystal deodorant in order retract the deodorant back into the container. This is disadvantageous because the deodorant is typically wet after use and the user will get the deodorant on his or her hands when pushing down on the top of the deodorant. Another disadvantage of this push-up package is that unless the user maintains pressure to the bottom of the crystal deodorant with his or her finger while applying the deodorant, the deodorant will retract back down into the package during application to the user's body. This makes application of the deodorant a cumbersome and difficult procedure.

SUMMARY OF THE INVENTION

It is therefore an object of the invention to provide an improved tube container which employs a rotating base for dispensing solid products.

It is another object of the invention to provide an improved tube container which employs a rotating base for dispensing solid crystal deodorants.

It is yet another object of the present invention to provide an improved tube container which enables the solid crystal deodorant to dry, after use.

It is still another object of the invention to provide an improved tube container which prevents the crystal rock deodorant from retracting into the container while being applied to the user's body.

It is yet still another object of the invention to provide an improved tube container which enables the crystal rock deodorant to be retracted back into the container without the need for the user to push on the top of the crystal rock deodorant.

In accordance with one embodiment of the invention, these and further objects are achieved in a tube container which houses a crystal rock deodorant. The tube container includes a cylindrical tube having an open end, a closed end and an elongated slot longitudinally disposed on the curved inside surface of the tube. The closed end of the cylindrical tube has an aperture for securing a rotatable cylindrical base. The cylindrical base has an open bottom end and a closed top end. The top end has an aperture for receiving a sleeve. A platform member for slidably supporting and displacing the crystal rock deodorant is located within the cylindrical tube. The platform member includes a disk with a diameter slightly less than the cylindrical tube inside diameter. The disk also has a notch disposed along its periphery for engaging with the elongated slot on the inside surface of the cylindrical tube which prevents the disk from rotating within the cylindrical tube. Extending perpendicularly upward from the top surface of the disk is a frictional projection which fits tightly into a hole in the bottom of the crystal deodorant. Extending perpendicularly downward from the lower surface of the disk is a threaded stem which is engaged in a threaded sleeve that is secured in an aperture in the top of the cylindrical base.

In another embodiment of the present invention, the stem extending below the disk is in the form of a helix which engages with finger-like protrusions on the inside surface of the cylindrical base sleeve.

These and further objects of the invention will become apparent to those of ordinary skill in the art by reference to the figures and detailed description which follow.

DETAILED DESCRIPTION

The present invention will now be described with reference to preferred embodiments in which the tube container is used to dispense solid crystal rock deodorant. While the preferred embodiment is described below with reference to a tube container for crystal deodorant, it will be apparent to those of ordinary skill in the art that the tube container of the present invention can be used for dispensing other types of solid products such as stick deodorants, glue sticks, and the like.

The present invention is also described with reference to embodiments in which the tube container is generally cylindrical. However, it is contemplated that the tube container may be designed and constructed using other geometries than described herein and still be within the scope of the present invention.

Figure 1:
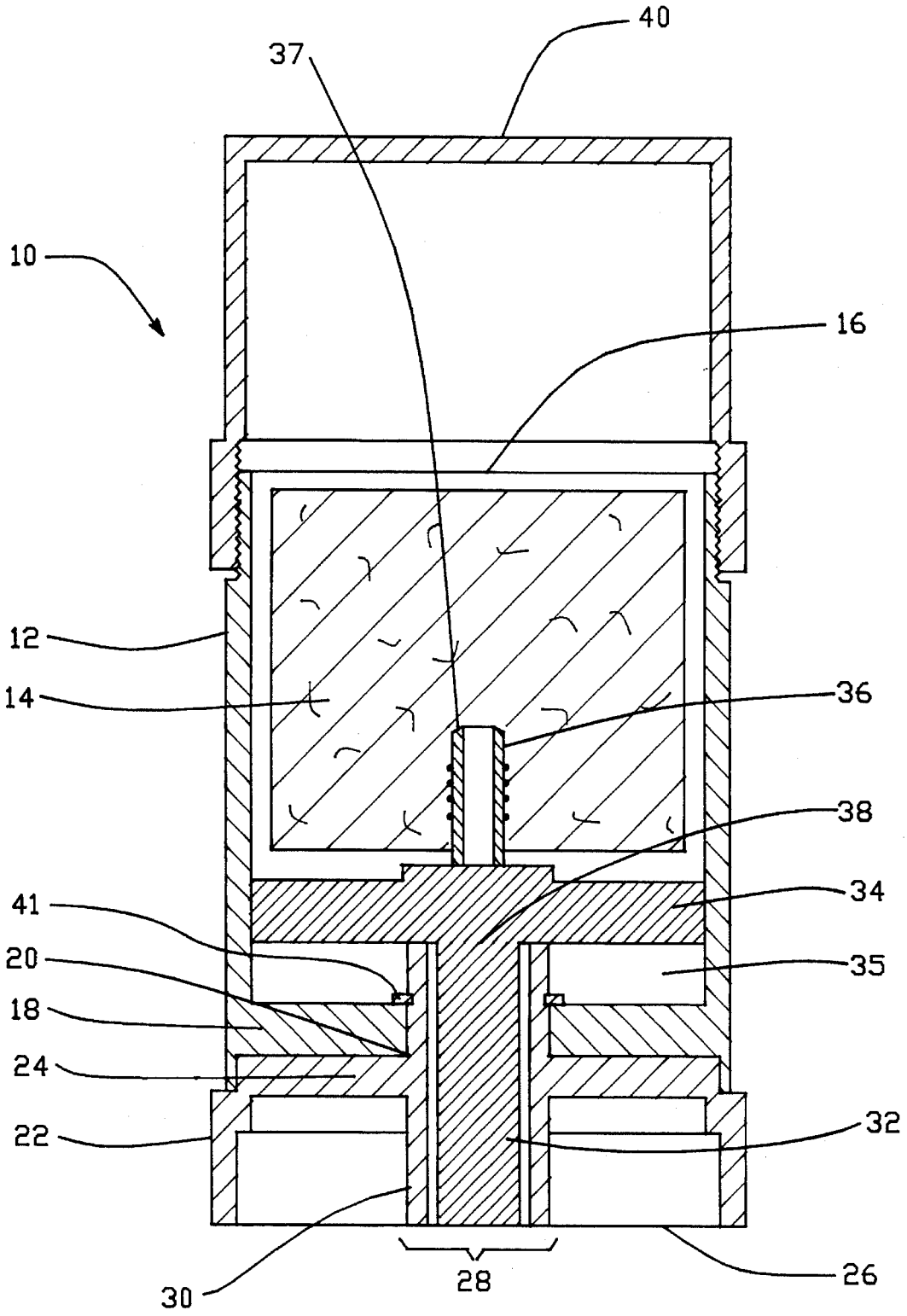
FIG. 1 is a cross-sectional view of a tube container according to the present invention.

A tube container 10 in accordance with a preferred embodiment of the invention is shown in FIG. 1. The tube container 10 includes a hollow cylindrical tube 12 for housing solid crystal deodorant 14. The cylindrical tube 12 has an open end 16 and a closed end 18. The closed end 18 of the cylindrical tube 12 has an aperture 20 for rotatably receiving a hollow cylindrical base 22. The cylindrical base 22 has a top closed end 24 and an open bottom end 26. The closed end 24 of the cylindrical base 22 has an aperture 28 for rigidly securing sleeve 30 having threads on its inside surface. Threaded sleeve 30 provides the means for rotatably securing the cylindrical base 22 to the bottom end 18 of the cylindrical tube 12. When secured to the cylindrical tube, threaded sleeve 30 also extends below the lower surface of cylindrical base top open end 26 for providing a channel for threaded stem 32, which is connected to the lower surface of disk 34. Threaded sleeve 30 also extends above the upper surface of the bottom closed end 18 of the cylindrical tube 12. This restricts vertical displacement of the disk 34 relative to the bottom end 18 of the cylindrical tube 12. When disk 34 is fully retracted within the tube container 12, the bottom surface of the disk 34 abuts against the top of the sleeve 30 creating an airspace 35 between disk 34 and the bottom end 18 of the cylindrical tube 12. Air space 35 permits the accumulation of excess water which flows down the sides of the crystal deodorant 14 after use.

Connected to the upper surface of disk 34 is a frictional projection 36 that fits tightly in a hole 37 located in the bottom of the crystal deodorant 14. Frictional projection 36 holds the crystal deodorant 14 in place on the top surface of disk 34. Other means for securing the crystal deodorant 14 to the top surface of disk 34 will be apparent to those skilled in the art and still be within the scope of the present invention. The threaded stem 32, disk 34 and frictional projection 36 form platform member 38 which is used to support and vertically displace the crystal deodorant 14 within the cylindrical tube 12. The cylindrical tube 12 is closed at its open end 16 by cap 40.

Vertical displacement of the crystal deodorant 14 within the cylindrical tube 12 is accomplished by cooperation of cylindrical tube 12, cylindrical base 22 and platform member 38. As shown in a preferred embodiment, FIG. 2, the cylindrical tube 12 has an elongated slot 42 disposed longitudinally along the inside surface of the tube. Disk 34 has a notch 44 which engages with slot 42 to restrict rotational movement of disk 34 during vertical displacement of platform member 38. Rotational movement of disk 34 may also be prevented by selecting a diameter of disk 34 such that disk 34 frictionally engages the interior surface of cylindrical tube 12 so that disk 34 resists rotational movement but not vertical movement.

Figure 2:
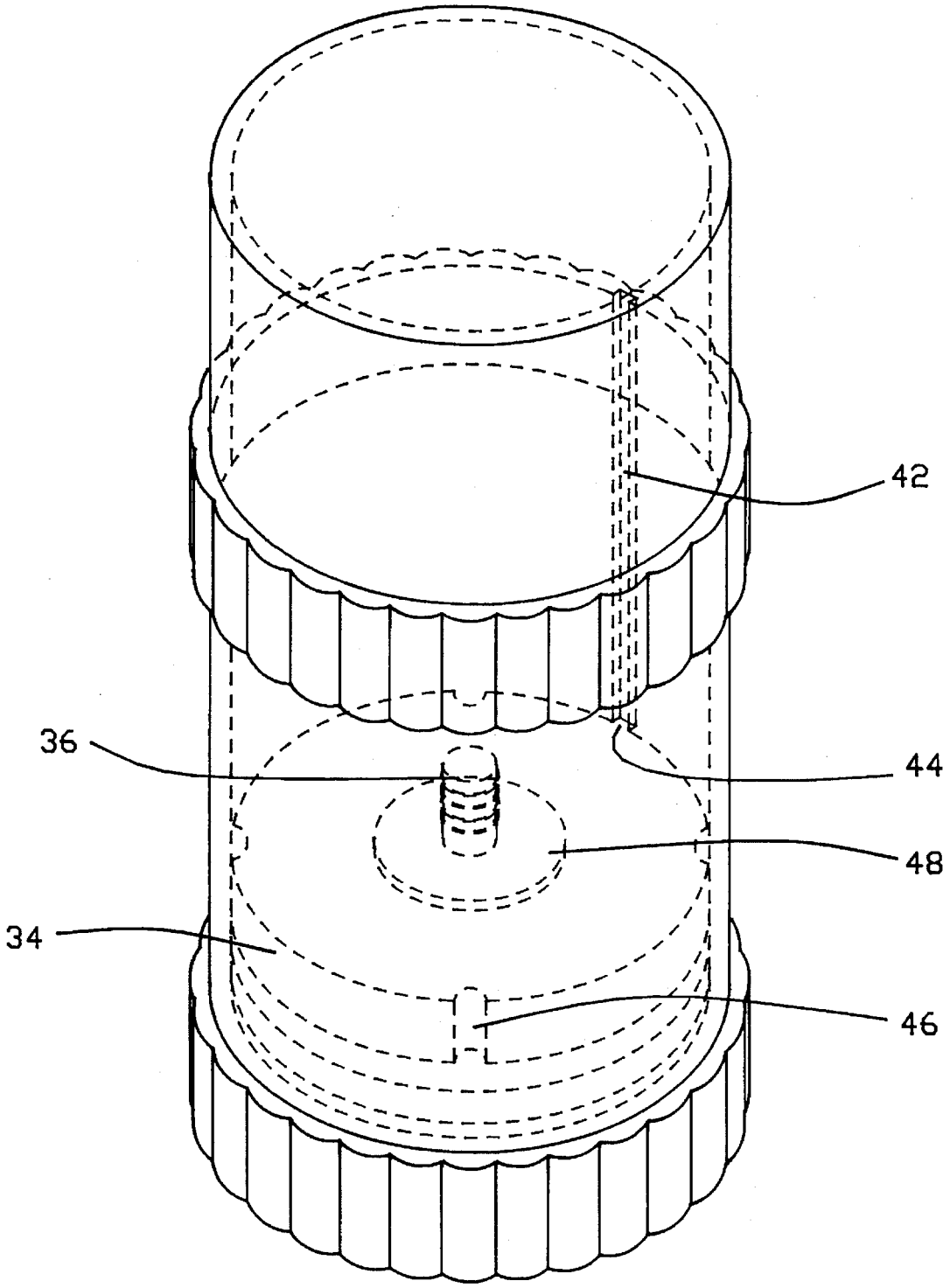
FIG. 2 is a perspective view of the tube container according to the present invention.

Referring now to FIG. 1, rotation of the cylindrical base 22 clockwise relative to the stationary cylindrical tube 12 causes the threaded stem 32 of the platform member 38 to move upward within the sleeve 30 of the cylindrical base 22. This in turn causes the disk 34 of the platform member 38 to move vertically upward within the cylindrical tube 12. The platform member 38 is prevented from rotation within the cylindrical tube 12 because notch 44 has engaged with slot 42 as shown in FIG. 2. Rotation of the cylindrical base 22 in a counterclockwise direction relative to the stationary cylindrical tube 12 causes the platform member 38 to retract vertically downward toward the bottom end 18 of cylindrical tube 12. While the operation of the tube container has been described with reference to clockwise rotation of the cylindrical base for upward movement of the platform member 38, it will be apparent to those skilled in the art that the tube container can be constructed such that counterclockwise rotation will result in upward movement of the platform member 38 and still be with the scope of the present invention.

Figure 3:
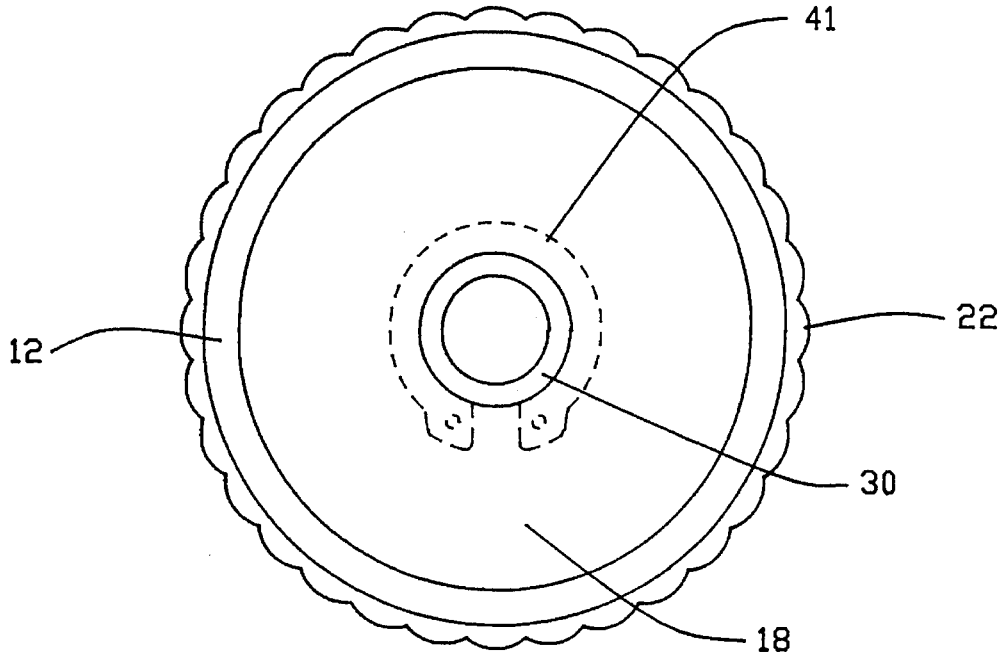
FIG. 3 is an end view of the cylindrical tube with the cylindrical base in place and without the platform member in place according to the present invention.

As shown in FIGS. 1 and 3, the cylindrical base 22 is rotatably secured to the bottom end 18 of the cylindrical tube 12 by collar 41 which is engaged in a groove (not shown) around the top portion of the sleeve 30. Collar 41 prevents the cylindrical base 22 from detaching from the cylindrical tube 12, but permits the cylindrical base 22 to be rotated freely by the user. Other means for rotatably securing the cylindrical base 22 to the cylindrical tube 12 will be apparent to those of ordinary skill in the art and still be within the scope of the present invention.

As is well known, when crystal deodorant 14 is used, it is first wetted with water by holding it under a running tap or immersing it in a sink filled with water. The crystal deodorant 14 then is used in a conventional manner by applying it to the body where it is desired. After use, the cap 40 typically is placed on the cylindrical tube open end 16 even though the crystal deodorant 14 still has excess water on it. If water is left on the crystal deodorant 14, or if the bottom portion of the crystal deodorant 14 is submerged in water, it will eventually deteriorate by becoming soft. When this happens, the crystal deodorant 14 may be unusable in the manner intended. Thus, to prevent this from happening and to prolong the life of the crystal deodorant 14, the water must be allowed to drain off of and away from the crystal deodorant 14 after use.

As shown in FIG. 1, the crystal deodorant 14 has an external diameter which is slightly less than the internal diameter of the cylindrical tube 12. The distance between the external diameter of the crystal deodorant 14 and the internal diameter of the cylindrical tube 12 is selected to be sufficient to permit water to pass downwardly past the outer edge of the crystal deodorant 14, onto the upper surface of the disk 34. Like the crystal deodorant 14, the diameter of the disk 34 is slightly less than the internal diameter of the cylindrical tube 12. The distance between the external diameter of the crystal deodorant 14 and the internal diameter of the cylindrical tube 12 is selected to be sufficient to permit water to pass downwardly past the outer edge of the disk 34 and accumulate in airspace 35.

Figure 4:
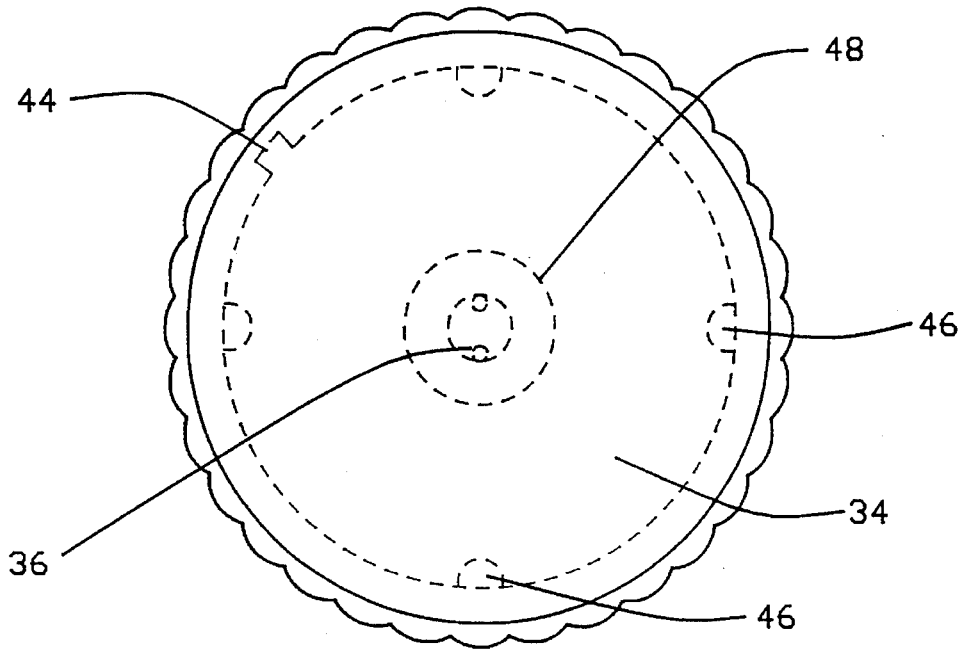
FIG. 4 is another end view of the cylindrical tube with the platform member in place according to the present invention.

In a preferred embodiment of the present invention as shown in FIGS. 2 and 4, disk 34 may have detents 46 along its outside periphery for channeling any excess water away from the crystal deodorant 14 which has drained down the sides of the deodorant onto the disk 34. This prevents the water from accumulating at or around the base of crystal deodorant 14 after use. Disk 34 may also have holes (not shown) through it to provide more fluid drainage from the disk 34 top surface. Further, a spacer 48 may be secured to the top surface of disk 34 around the base of frictional projection 36 to create an air space between the crystal deodorant 14 (not shown) and the disk 34.

In another embodiment, the bottom end 26 of the cylindrical base is closed for housing a fluid absorption material (not shown), such as a sponge, for capturing the excess water which has drained from the crystal deodorant 14. The fluid absorption material may be formed in a single annular ring or in multiple sections so that it is contained within the cavity of the cylindrical base 22 formed around the sleeve 30. The closed bottom end of the cylindrical base 22 may also have holes through it for permitting the evaporation and the passage of fluid that is captured in the fluid absorption material. If a relatively small amount of water is absorbed by the fluid absorption material, the material holds the water, which then is slowly evaporated through the holes in the closed bottom end of the cylindrical base 24. If a relatively large amount of water is present, it is possible for the fluid absorption material to become saturated. When this occurs, the remainder of the water then flows outwardly through the holes in the closed bottom end of the cylindrical base 24. In either case, no puddling of water on the bottom of the crystal deodorant 14 occurs and it is preserved for repeated use.

Figure 5:
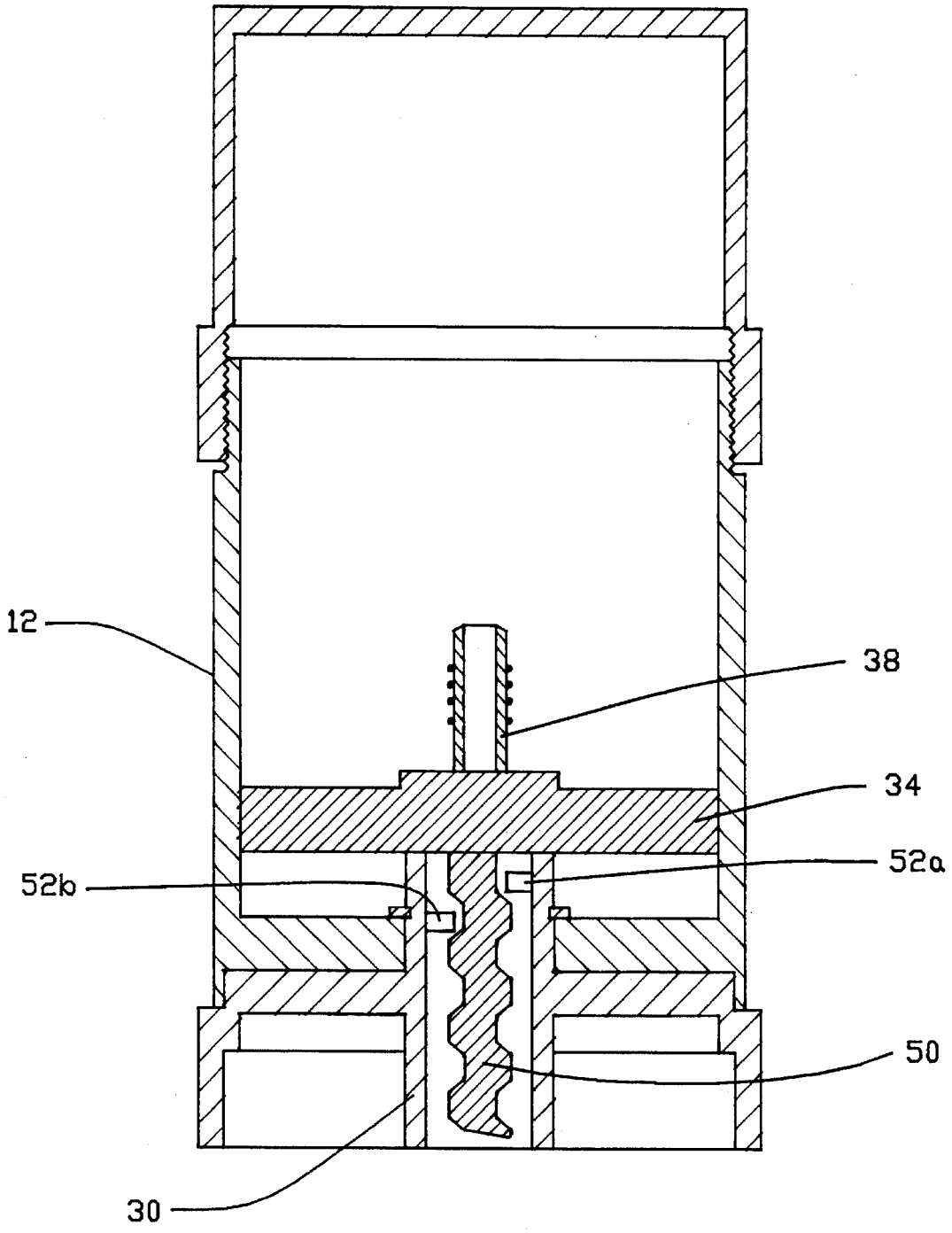
FIG. 5 is a perspective view of the tube container according to another embodiment of the present invention.

In a preferred embodiment as shown in FIG. 5, the stem 21 may be in the form of a helix or corkscrew-like member. In this embodiment, the inside surface of the sleeve 30, rather than having threads, has two finger-like protrusions 52*a*, 52*b* diametrically opposed to each other which engage with the groove around stem 50 for vertical displacement of the platform member 38 within the cylindrical tube 12. Protrusion 52*a* is positioned closer to the top end of the sleeve 30 than protrusion 52*b*. In operation, rotation of the cylindrical base 22 in the clockwise direction relative to the stationary cylindrical tube 12 causes the stem 20 of the platform member 38 to move vertically upward within the sleeve 30 of the cylindrical base 22. This in turn causes the disk 34 of the platform member 38 to move vertically upward within the cylindrical tube 12. Rotation of the cylindrical base 22 in a counterclockwise direction relative to the stationary cylindrical tube 12 causes the platform member 3 8 to retract downward toward the bottom end 18 of the cylindrical tube 12.

While the invention has been described herein with respect to certain embodiments, these embodiments are presented for purposes of illustration and are not intended to limit the invention in anyway. These and other embodiments and features are intended to be within the scope of the invention without departing from the spirit of the invention.

We claim:

1. In combination:

A) a solid crystal rock deodorant: and

B) a tube container for said solid crystal rock deodorant comprising:

1) a cylindrical tube for slidably containing the solid crystal rock deodorant, the cylindrical tube having a base end and a dispensing end;

2) a cylindrical base rotatable relative to the base end of the cylindrical tube;

wherein rotation of the cylindrical base relative to the cylindrical tube causes the solid crystal rock deodorant to be displaced along the cylindrical tube longitudinal axis and out of the dispensing end.

2. The combination of claim 16 wherein the container further comprises a removable cap for the dispensing end of the cylindrical tube.

3. A method of applying a solid crystal rock deodorant to a body comprising the steps of:

A) providing a solid crystal rock deodorant in a tube container having:

1) a cylindrical tube for slidably containing the solid crystal rock deodorant, the cylindrical tube having a base end and a dispensing end;

2) a cylindrical base rotatable relative to the base end of the cylindrical tube;

B) rotating the cylindrical base relative to the cylindrical tube to extend the solid crystal rock deodorant a sufficient distance out of the cylindrical tube dispensing end to enable the application of the deodorant to a body; and C) applying the solid crystal rock deodorant to a body.

4. A container for crystal rock deodorant comprising:

1) a cylindrical tube for slidably securing a crystal rock deodorant, the tube having:

a) a first open end;

b) a second closed end having an aperture;

2) a cylindrical base rotatably secured in the aperture of the cylindrical tube closed end; and 3) a platform member for slidably supporting the crystal rock deodorant within the cylindrical tube, the platform member being selectively, movably attached to the cylindrical base;

wherein rotation of the base relative to the cylindrical tube causes the platform member to be displaced vertically along the cylindrical tube longitudinal axis.

5. The container of claim 4 wherein the platform further comprises:

a) a disk with a diameter slightly less than the cylindrical tube inside diameter, the disk having an upper deodorant supporting surface and a lower surface;

b) a threaded stem extending perpendicularly downward from the disk lower surface;

and further wherein the cylindrical base comprises:

a) a top end having an aperture;

b) a sleeve having a threaded inside surface, the sleeve being rigidly attached in the cylindrical base top end aperture, and rotatably secured in the aperture of the cylindrical tube closed end;

wherein rotation of the base relative to the cylindrical tube causes the sleeve to rotate thereby causing the platform member to be displaced vertically along the cylindrical tube longitudinal axis.

* * * * *

UNITED STATES PATENT AND TRADEMARK OFFICE

CERTIFICATE OF CORRECTION

PATENT NO. : 5,518,715

DATED : May 21, 1996

INVENTOR(S) : Jerry Rosenblatt

It is certified that error appears in the above-indentified patent and that said Letters Patent is hereby corrected as shown below:

Claim 2, Column 5, Line 45:
After "claim" and before "wherein"
delete "16" and substitute
therefor -1-

Signed and Sealed this

Third Day of September, 1996

*Attest:*

Bruce Lehman

BRUCE LEHMAN

*Attesting Officer*

*Commissioner of Patents and Trademarks*